US009074406B2

(12) United States Patent
Vos et al.

(10) Patent No.: US 9,074,406 B2
(45) Date of Patent: Jul. 7, 2015

(54) FENESTRATION UNIT REPLACEMENT METHOD AND SYSTEM

(71) Applicant: Pella Corporation, Pella, IA (US)

(72) Inventors: Jaron E. Vos, Pella, IA (US); Paul D. Schroder, Pella, IA (US); Andrew P. Schirz, Leighton, IA (US); Mark D. McClellan, Prairie City, IA (US); Richard M. Raab, East Syracuse, NY (US); Ted A. Grier, Pella, IA (US)

(73) Assignee: Pella Corporation, Pella, IA (US)

( * ) Notice: Subject to any disclaimer, the term of this patent is extended or adjusted under 35 U.S.C. 154(b) by 0 days.

(21) Appl. No.: 14/339,297

(22) Filed: Jul. 23, 2014

(65) Prior Publication Data

US 2014/0331575 A1 Nov. 13, 2014

Related U.S. Application Data

(62) Division of application No. 13/014,542, filed on Jan. 26, 2011, now Pat. No. 8,833,035.

(51) Int. Cl.

| | |
|---|---|
| ***E04D 1/36*** | (2006.01) |
| ***E04D 3/38*** | (2006.01) |
| ***E04D 13/14*** | (2006.01) |
| ***E06B 7/14*** | (2006.01) |
| ***E06B 1/62*** | (2006.01) |

(Continued)

(52) U.S. Cl.

CPC ..... *E06B 7/14* (2013.01); *Y10T 29/4973* (2015.01); *E06B 1/62* (2013.01); *E06B 1/68* (2013.01); *E06B 2001/622* (2013.01); *E06B 2001/628* (2013.01); *E06B 1/702* (2013.01)

(58) Field of Classification Search

CPC ..... E06B 7/14; E06B 1/62; E06B 1/68; E06B 1/702; E06B 2001/622; E06B 2001/628; Y10T 29/4973

USPC ..... 52/204.1, 209, 204.5, 61, 62

See application file for complete search history.

(56) References Cited

U.S. PATENT DOCUMENTS

| | | | |
|---|---|---|---|
| 304,183 | A | 8/1884 | Davis |
| 396,327 | A | 1/1889 | Crane |
| 1,377,349 | A | 5/1921 | Holder |

(Continued)

OTHER PUBLICATIONS

Clad Casement & Awning Window Installation Instructions, 5 pages, .COPYRGT. Pella Corporation, 2004.

(Continued)

*Primary Examiner* — Brian Glessner
*Assistant Examiner* — Brian D Mattei
(74) *Attorney, Agent, or Firm* — Faegre Baker Daniels LLP

(57) ABSTRACT

A water management system installation including framing, a jamb liner, a head liner, and a sill liner. The jamb liner having a cross-section and including a first landing and first and second walls defining an elongated channel, and a second landing extending from the second wall and vertically offset from the first landing, the second landing positioned toward a first jamb member with the first wall disposed toward the exterior side of the building structure. The head liner having a cross-section that is substantially the same as the cross-section of the jamb liner, the second landing of the head liner positioned toward a head member with the first wall disposed toward the exterior side of the building structure. The sill liner having a cross-section and including a first landing positioned toward a sill member with a wall disposed toward the interior side of the building structure.

14 Claims, 10 Drawing Sheets

(51) Int. Cl.
*E06B 1/68* (2006.01)
*E06B 1/70* (2006.01)

(56) References Cited

U.S. PATENT DOCUMENTS 1,429,527 A 9/1922 Paul
1,668,564 A 5/1928 Jenkins
1,836,980 A 12/1931 Marty
1,881,778 A 10/1932 Madsen
1,929,633 A 10/1933 Gifford
2,169,985 A 8/1939 Hiza
2,305,252 A 12/1942 Hayden
2,440,918 A 5/1948 Schiessl
2,497,515 A 2/1950 Pearse
2,624,067 A 1/1953 Tassell
2,700,441 A 1/1955 Cudini
2,879,660 A 3/1959 Reintjes
2,952,947 A 9/1960 White
3,192,670 A 7/1965 Jones, III
3,250,049 A 5/1966 Sklar
3,375,627 A 4/1968 Bursiek et al.
3,566,542 A 3/1971 Gillen et al.
3,571,996 A 3/1971 Braswell
3,585,770 A 6/1971 Maizler
3,599,379 A 8/1971 Tuska
3,681,876 A 8/1972 Linder et al.
3,690,079 A 9/1972 Hemminger
3,692,040 A 9/1972 Kundert
3,782,064 A 1/1974 Hubbard et al.
3,811,150 A 5/1974 Chalmers
3,851,420 A 12/1974 Tibbetts
3,861,444 A 1/1975 Portwood
3,889,423 A 6/1975 Begin
3,919,815 A 11/1975 Alabaster
3,963,269 A 6/1976 Rosenberg
4,001,972 A 1/1977 Hurwitz
4,055,923 A 11/1977 Biebuyck
4,080,763 A 3/1978 Naidus et al.
4,141,190 A 2/1979 Shimada
4,228,630 A * 10/1980 Englert et al. ..... 52/656.9
4,295,299 A 10/1981 Nelson
4,330,972 A 5/1982 Sailor
4,335,550 A * 6/1982 Johnson ..... 52/99
4,341,048 A * 7/1982 Minter ..... 52/204.53
4,387,542 A 6/1983 Wehr
4,406,300 A 9/1983 Wilson
4,473,981 A 10/1984 Simpson
4,488,391 A 12/1984 Pavnica
4,489,517 A 12/1984 Young
4,555,882 A 12/1985 Moffitt et al.
4,608,800 A * 9/1986 Fredette ..... 52/656.1
4,621,478 A 11/1986 Phillips et al.
4,627,206 A 12/1986 Cox
4,637,183 A 1/1987 Metz
4,644,717 A 2/1987 Biebuyck
4,672,784 A 6/1987 Pohlar
4,691,487 A * 9/1987 Kessler ..... 52/209
4,713,922 A 12/1987 Ingold
4,715,152 A 12/1987 Tankiawa
4,731,952 A 3/1988 Mascotte
4,731,965 A 3/1988 Jensen
4,821,472 A 4/1989 Tix
4,844,520 A 7/1989 Muller, Jr.
4,852,312 A 8/1989 Harbom
4,854,621 A 8/1989 Baldwin
4,887,407 A 12/1989 Nelson
4,918,786 A 4/1990 Perry
4,958,469 A 9/1990 Plummer
5,018,333 A 5/1991 Bruhm
5,026,581 A 6/1991 Shea, Jr. et al.
5,042,199 A 8/1991 Schneider et al.
5,054,250 A 10/1991 Foss
5,157,881 A * 10/1992 Tashman et al. ..... 52/98
5,179,969 A 1/1993 Peterson
5,210,987 A 5/1993 Larkowski
5,299,399 A 4/1994 Baier et al.
5,319,884 A 6/1994 Bergeron
5,327,684 A 7/1994 Herbst
5,365,697 A 11/1994 Vanderpan
5,365,707 A 11/1994 Jones et al.
5,394,657 A 3/1995 Peterson
5,423,149 A 6/1995 Herbst
5,524,391 A 6/1996 Joffe et al.
5,542,217 A 8/1996 Larivee, Jr.
5,570,917 A 11/1996 Cutrer
5,572,840 A 11/1996 Fast et al.
5,655,342 A 8/1997 Guillemet et al.
5,655,343 A 8/1997 Seals
5,675,870 A 10/1997 Cooper
5,692,350 A 12/1997 Murphy, Jr.
5,701,780 A 12/1997 Ver Meer
5,722,207 A 3/1998 Anderson et al.
5,822,933 A 10/1998 Burroughs et al.
5,839,236 A 11/1998 Frey
5,857,299 A 1/1999 Gyllenberg et al.
5,875,602 A * 3/1999 Lappin et al. ..... 52/712
5,890,331 A 4/1999 Hope
5,899,026 A 5/1999 Williams et al.
5,906,083 A * 5/1999 Olsen et al. ..... 52/473
5,921,038 A 7/1999 Burroughs et al.
5,927,039 A 7/1999 De Boer
5,934,828 A 8/1999 Hu et al.
5,937,597 A 8/1999 Sono et al.
6,014,846 A 1/2000 Sono et al.
6,018,916 A 2/2000 Henry
6,076,310 A 6/2000 Kim
6,098,343 A 8/2000 Brown et al.
6,141,922 A 11/2000 Carlisle et al.
6,161,344 A 12/2000 Blanchett
6,170,198 B1 1/2001 Staples et al.
6,170,207 B1 1/2001 Saindon
6,185,792 B1 2/2001 Nelson et al.
6,216,402 B1 4/2001 Van de Laar
6,223,484 B1 5/2001 Minter
6,256,956 B1 7/2001 Davis
6,276,099 B1 * 8/2001 O'Shea ..... 52/204.1
6,293,061 B1 9/2001 Horak, Jr.
6,357,200 B1 3/2002 Vanderpan
6,374,557 B1 4/2002 O'Donnell
6,381,911 B1 5/2002 Weiland
6,385,925 B1 5/2002 Wark
6,401,402 B1 6/2002 Williams
6,405,501 B1 6/2002 Cerrato
6,408,922 B2 6/2002 Desrochers
6,519,899 B1 2/2003 Hurzeler
6,526,709 B1 * 3/2003 Jacobsen ..... 52/211
6,536,176 B1 3/2003 Nordgren et al.
6,550,210 B1 4/2003 Levine et al.
6,634,146 B2 10/2003 Carlson
6,722,089 B2 4/2004 Budzinski
6,823,633 B2 11/2004 Ryan
6,832,457 B2 12/2004 Geiger
6,894,083 B2 5/2005 Braun et al.
7,100,337 B1 9/2006 Nordgren et al.
7,134,246 B1 11/2006 Olberding et al.
7,237,365 B1 7/2007 Phandanouvong
7,367,164 B2 5/2008 Burton
7,490,441 B2 2/2009 Burton et al.
7,600,346 B2 10/2009 Meeks
7,669,382 B2 3/2010 Burton et al.
7,930,860 B2 4/2011 Sawada
8,006,445 B2 8/2011 Burton et al.
8,448,384 B2 5/2013 Wernlund et al.
8,833,035 B2 9/2014 Vos et al.
2001/0034984 A1 11/2001 Murphy et al.
2002/0157328 A1 10/2002 Holder
2003/0177699 A1 9/2003 Fukuro et al.
2003/0177710 A1 9/2003 Gatherum
2003/0177711 A1 9/2003 Gatherum
2003/0177712 A1 9/2003 Gatherum
2003/0177725 A1 9/2003 Gatherum
2003/0177726 A1 9/2003 Gatherum et al.
2003/0177727 A1 9/2003 Gatherum
2003/0188498 A1 10/2003 Lewkowitz

(56) References Cited

U.S. PATENT DOCUMENTS

| | | | |
|---|---|---|---|
| 2004/0020143 | A1 | 2/2004 | Webb |
| 2005/0050815 | A1 | 3/2005 | Engebretson |
| 2005/0097837 | A1 | 5/2005 | Burton |
| 2005/0138875 | A1 | 6/2005 | Grunewald et al. |
| 2005/0144856 | A1 | 7/2005 | Conlin |
| 2005/0144865 | A1 | 7/2005 | Ellingson |
| 2005/0188625 | A1 | 9/2005 | Cantrell |
| 2005/0193654 | A1 | 9/2005 | Primozich |
| 2005/0235571 | A1 | 10/2005 | Ewing et al. |
| 2005/0262771 | A1 | 12/2005 | Gorman |
| 2005/0262782 | A1 | 12/2005 | Harrison et al. |
| 2006/0080894 | A1 | 4/2006 | Saelzer |
| 2006/0101726 | A1 | 5/2006 | Collins |
| 2006/0137262 | A1 | 6/2006 | Crowder-Moore et al. |
| 2006/0150524 | A1 | 7/2006 | Kibbel et al. |
| 2006/0213135 | A1 | 9/2006 | Mathes et al. |
| 2006/0230593 | A1 | 10/2006 | Eggen et al. |
| 2006/0236618 | A1 | 10/2006 | Williams |
| 2006/0272238 | A1 | 12/2006 | Honda |
| 2006/0272274 | A1 | 12/2006 | Burton et al. |
| 2007/0056231 | A1 | 3/2007 | DiMario et al. |
| 2007/0094957 | A1 | 5/2007 | Burton et al. |
| 2007/0125013 | A1 | 6/2007 | Prince |
| 2007/0166498 | A1 | 7/2007 | Penar |
| 2007/0169425 | A2 | 7/2007 | Takagi et al. |
| 2007/0214738 | A1 | 9/2007 | Koessler |
| 2008/0110110 | A1 | 5/2008 | Burton et al. |
| 2008/0127564 | A1 | 6/2008 | Burton et al. |
| 2008/0178557 | A1 | 7/2008 | Parsons et al. |
| 2009/0049780 | A1 | 2/2009 | Pulte et al. |
| 2009/0183453 | A1 | 7/2009 | Koessler et al. |
| 2009/0272045 | A1* | 11/2009 | Teodorovich ..... 52/58 |
| 2010/0139178 | A1 | 6/2010 | Ehrman et al. |
| 2010/0170186 | A1* | 7/2010 | Hohmann, Jr. ..... 52/741.4 |
| 2010/0281787 | A1 | 11/2010 | Jay et al. |
| 2012/0186665 | A1 | 7/2012 | Vos et al. |

OTHER PUBLICATIONS

Clad Double-Hung Window Installation Instructions, 5 pages, .COPYRGT. Pella Corporation, 2004.

Installation Instruction: HurricaneShield.TM. / Advanced Performance Casement and Awning Windows, 4 pages, .COPYRGT. Pella Corporation, 2001.

Installation Instructions for New Construction Vinyl Window with Integral Nailing Fin, JELD-WEN Windows & Doors, copyright 2003, 6 pages.

Jamsill, Inc.; Jamsill Guard.TM., 5 pages, .COPYRGT. 2005, http://www.jamsill.com/Products.php.

Pella Corporation, Clad Frame Entry Door Installation Instructions, 5 pages, 2003.

Pella Corporation, "Entry Door—Wood and Clad Double Door installation instructions", 5 pages, 2003.

Pella Corporation, Wood Frame Entry Door & 20 Minute Fire Rated Entry Door Installation Instructions, 5 pages, 2003.

U.S. Appl. No. 60/726,573, filed Oct. 14, 2005, 19 pages.

Wood Window Installation, New Wood Frame Construction, Marvin Windows and Doors, Dec. 12, 2006, 13 pages.

* cited by examiner

FENESTRATION UNIT REPLACEMENT METHOD AND SYSTEM

CROSS-REFERENCE TO RELATED APPLICATION

This application is a Divisional of application Ser. No. 13/014,542, filed Jan. 26, 2011, which is herein incorporated by reference in its entirety.

BACKGROUND

Prior methods of replacing windows and other fenestration units in an existing structure, especially stucco covered structures, have included utilizing a flush flange window design, also described as a pocket replacement, where the frame of the pre-existing window is left in place while the sashes are removed from the pre-existing window assembly. The new window is then inserted from the exterior of the building and centered in the prepared opening, including the pre-existing window frame. The window flange is secured tight against the window frame, an exterior seal is created by sealing the flange to the stucco with sealant placed on the flanges of the new window, and an interior seal is created by sealing the window frame to the existing window assembly. A second, more involved methodology is also used where the exterior stucco is chipped away to reveal the pre-existing window frame and nailing fin and the entire pre-existing window assembly is removed prior installation of the new window assembly. Similarly methodology is employed with other types of fenestration units, such as pre-hung door assemblies. Improvements remain to be made over either method, where leaving the pre-existing frame in the rough opening can be problematic from aesthetic and weatherability standpoints and removal and replacement of the stucco surface is labor intensive.

SUMMARY

Some embodiments relate to an replacement installation that is provided, in some implementations, by cutting around the pre-existing fenestration unit, removing the pre-existing fenestration unit, installing a water management system, and installing the replacement fenestration unit, the methodology thereby helping to minimize damage to a finished exterior surface of the structure in which the replacement fenestration unit is being installed and accomplishing a more efficient and effective means for installing a replacement fenestration unit while maintaining water integrity of the structure.

Some embodiments relate to a method of replacing an existing fenestration unit secured in a rough opening in a wall having a finished exterior. The method includes releasing an existing fenestration unit from the wall by cutting around the existing fenestration unit, including cutting into the finished exterior of the wall and through a perimeter portion of the existing fenestration unit to release the fenestration unit from the wall. The method also includes removing the existing fenestration unit from the rough opening in the wall, installing a water management system along a sill of the rough opening, and inserting a new fenestration unit into the rough opening. The new fenestration unit is secured in the rough opening.

Some embodiments relate to a method of preparing a water management system for installation in a rough opening. The method includes cutting a sill liner of a desired length from a segment of material, the segment material being pre-formed with a first base extending between a first end and a second end, a first flange extending from the first end of the first base and a second flange extending from the second end of the first base, the segment of material defining an elongate channel between the first and second flanges, and a second base extending from the second flange, the first and second bases being vertically offset from one another. The method also includes forming a drainage port into the first flange of the sill liner and cutting a jamb liner of a desired length from a piece of the blank material.

Some embodiments relate to a water management system installation. The installation includes framing including a first jamb member, a second jamb member, a head member, and a sill member, the first and second jamb members, the head member, and the sill member defining a rough opening in a building structure having an exterior side and an interior side. The installation also includes a first jamb liner having a cross-section and including a first landing extending between a first end and a second end, a first wall extending from the first end of the first landing and a second wall extending from the second end of the first landing, the blank material defining an elongate channel between the first and second walls, and a second landing extending from the second wall, the first and second landings being vertically offset from one another, the second landing being positioned toward the first jamb member with the first wall disposed toward the exterior side of the building structure. The installation also includes a head liner having a cross-section that is substantially the same as the cross-section of the jamb liner, the head liner including a first landing extending between a first end and a second end, a first wall extending from the first end of the first landing and a second wall extending from the second end of the first landing, the blank material defining an elongate channel between the first and second walls, and a second landing extending from the second wall, the first and second landings being vertically offset from one another, the second landing being positioned toward the head member with the first wall disposed toward the exterior side of the building structure.

While multiple embodiments are disclosed, still other embodiments of the present invention will become apparent to those skilled in the art from the following detailed description, which shows and describes illustrative embodiments of the invention. Accordingly, the drawings and detailed description are to be regarded as illustrative in nature and not restrictive.

Figure 1A:
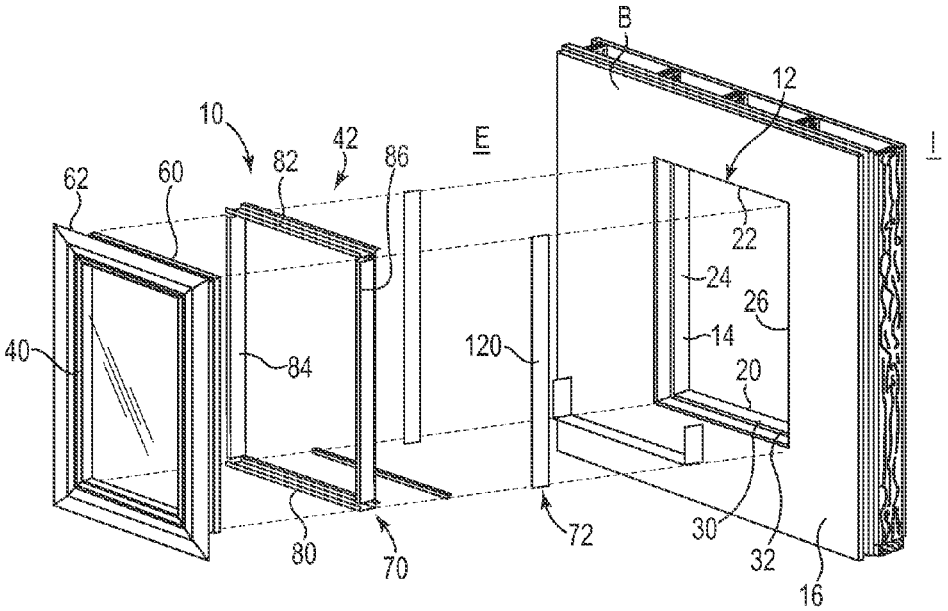
FIG. 1A shows selected portions of a replacement installation for a rough opening in a building, according to some embodiments.

While the invention is amenable to various modifications and alternative forms, specific embodiments have been shown by way of example in the drawings and are described in detail below. The intention, however, is not to limit the invention to the particular embodiments described. On the contrary, the invention is intended to cover all modifications, equivalents, and alternatives falling within the scope of the invention as defined by the appended claims.

DETAILED DESCRIPTION

Some embodiments relate, in part, to a replacement installation for a pre-existing fenestration unit in a finished exterior structure. The replacement installation is provided, in some implementations, by cutting around the pre-existing fenestration unit and installing a water management system, thereby minimizing damage to the finished exterior surface and accomplishing a more efficient and effective means for installing a replacement fenestration unit. Although some features and advantages are described accordingly, additional and alternate features and advantages are to be understood with reference to the description and drawings.

FIG. 1A shows a replacement installation 10 for a rough opening 12 in a building structure B formed by a substructure 14 (also described as a framing) defining the rough opening 12, a finished exterior 16 on an exterior side E of the building B, and a finished interior 18 (FIG. 20) on an interior side I of the building B, according to some embodiments. As shown, the substructure 14 defines various portions of the rough opening 12, including a sill 20, a head 22 opposite the sill 20, a first jamb 24, and a second jamb 26 opposite the first jamb 24. In some embodiments, the finished exterior 16 is a stucco finish (e.g., including a weather barrier, metal lath, one or more plaster layers, and/or other materials), though alternate or additional finished exteriors are contemplated (e.g., brick, tile, or other finished surfaces). The interior 18 optionally includes a layer of drywall and/or other materials (e.g., vapor barrier material). A drywall return 30 (or other material) defining an exterior edge 32 is optionally secured to the sill 20, head 22, and jambs 24, 26 as desired.

As shown in FIG. 1A, the replacement installation 10 includes a fenestration unit 40 and a water management system 42. In some embodiments, the replacement installation 10 is provided as part of a method of replacing a pre-existing fenestration unit 44 (FIG. 1B) previously installed in the rough opening 12 of the substructure 14.

Figure 1B:
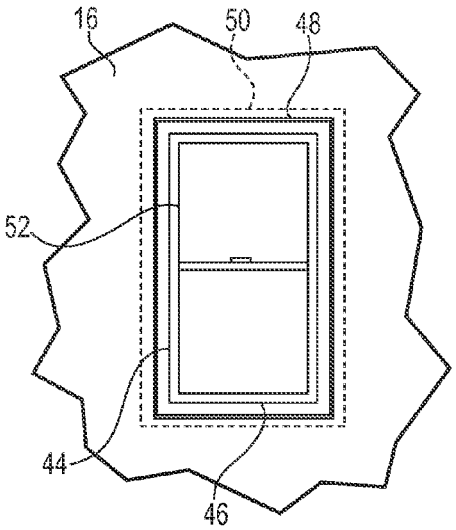
FIG. 1B shows a pre-existing fenestration unit in the rough opening.

As shown in FIG. 1B, in some embodiments, the pre-existing fenestration unit 44 includes a frame 46 defining an outer perimeter 48, a nailing fin 50 projecting beyond the outer perimeter 48 of the frame, and a sash assembly 52. The nailing fin 50 is secured to the substructure 14 (FIG. 1A) with portions of the finished exterior 16 extending over the nailing fin 50 and adjacent the outer perimeter 48 of the frame 46. In other words, in some embodiments, the pre-existing fenestration unit 44 is first installed to the substructure 14 with the finished exterior 16 subsequently applied over both the substructure 14 and portions of the pre-existing fenestration unit 44, such as the nailing fin 50.

The fenestration unit 40 is optionally a window unit or a door unit, for example. As shown in FIG. 1, the fenestration unit 40 is a window insert having a frame 60 and a flange 62. During installation, the frame 60 is received in the rough opening 12 with the flange 62 adapted to abut or reside adjacent portions of the finished exterior 16 and/or substructure 14, for example. Similarly, although in some embodiments, the pre-existing fenestration unit 44 is a window assembly (e.g., a double hung window with a nailing fin), the pre-existing fenestration unit 44 is optionally a different type of window or a different type of fenestration unit, such as a pre-hung door.

Figure 2A:
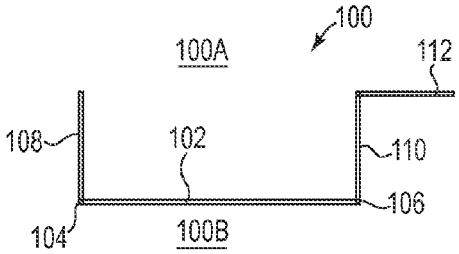
FIGS. 2A and 2B show a segment of liner material of the water management system of FIG. 1A, according to some embodiments.
Figure 2B:
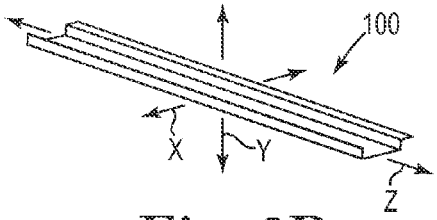

The water management system 42 includes a liner system 70 and a barrier system 72. The liner system 70 includes a sill liner 80, a head liner 82, a first jamb liner 84, and a second jamb liner 86. In some embodiments, the liners 80, 82, 84, 86 are each formed during installation from substantially the same preformed liner material (though not necessarily the same piece of liner material), where a segment of the liner material 100 is shown in FIGS. 2A and 2B, where FIG. 2A is an end view and FIG. 2B is a perspective view. In other words, in some embodiments, two or more of the liners 80, 82, 84, 86 are formed during installation from a single piece of liner material, though utilization of pre-separated pieces of liner material for each of the liners 80, 82, 84, 86 is contemplated. The liner material is optionally metallic (e.g., aluminum) or polymeric (e.g., polypropylene), or other type of material, depending upon implementation.

As shown in FIGS. 2A and 2B, the liner material 100 defines a length along a longitudinal axis Z, a width along an installation axis X, and depth along a support axis Y, as well as a first side 100A and a second side 100B on opposite sides of a transverse cross-section of the liner material 100. The liner material 100 includes a first base 102, also described as a landing, having a first end 104 and a second end 106, a first flange 108, also described as a wall, extending substantially perpendicular from the first end 104 of the first base 102, a second flange 110, also described as a wall, extending substantially perpendicular from the second end 106 of the first base 102, and a second base 112, also described as a landing, extending substantially perpendicular from the first base 102. The first and second flanges 108, 110 and the first base 102 define a channel 114 for conveying moisture, as subsequently described. As shown, the first and second bases 102, 112 are substantially planar and parallel to one another, one offset from the other (i.e., not coplanar, though parallel). In turn, the first and second flanges 108, 110 are also substantially planar and parallel to one another, one offset from the other (i.e., not coplanar, though parallel). The first and second flanges 108, 110 are positioned opposed to one another, where the first and second bases 102, 112 are offset from one another. As shown, the first and second bases 102, 112 define different widths, the first base 102 being substantially wider (e.g., about 1.5 inches wide) than the second base 112 (e.g., about 0.5 inches wide). In turn, the first and second flanges 108, 110 define substantially the same depth (e.g., about 0.5 inches each).

As shown in FIG. 1A, the barrier system 72 includes flashing 120 to help reduce the potential for water ingress into the interior side I of the building B. The flashing 120 is optionally flashing tape, such as butyl flashing tape sold under the trade name "SMARTFLASH," by Pella Corporation of Pella, Iowa. The barrier system 72 also optionally includes various sealant layers, optionally applied as a liquid by the installer, as described in greater detail below.

Some examples of methods of removing the pre-existing fenestration unit 44, preparing the rough opening 12, and installing the fenestration unit 40 follow. In some fenestration unit replacement and installation methods, the fenestration unit 40 is removed from associated packaging, inspected, and measured to confirm the fenestration unit 40 will fit into the rough opening 12 prior to removing the pre-existing fenestration unit 44 from the rough opening 12. In some embodiments, the fenestration unit 40 is preferably determined to be a minimum of 0.5 inch smaller in width and height than a pre-existing interior drywall return 30, or 1.5 inches smaller in width and height than the rough opening 12.

Figure 3:
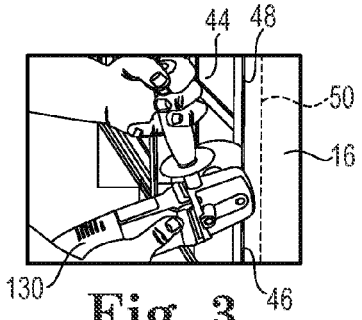
FIGS. 3-6 are illustrative of a method of removing the pre-existing fenestration unit from the rough opening, according to some embodiments.
Figure 4:
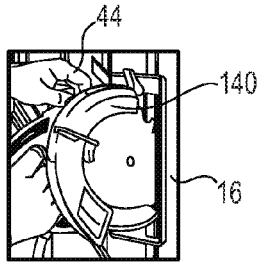
Figure 5:
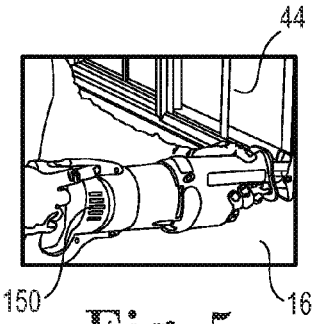

FIGS. 3 to 5 illustrate a manner of removing the pre-existing fenestration unit 44 according to some embodiments. The pre-existing fenestration unit 44 is optionally removed by cutting through the nailing fin 50 using an appropriate cutting implement, and also cutting through the finished exterior 16 where the finished exterior 16 sufficiently overlaps the nailing fin 50. The installer cuts about the outer perimeter 48 of the pre-existing fenestration unit 44, on all sides of the fenestration unit 44 in order to release the pre-existing fenestration unit 44 from the rough opening 12. In some embodiments, the installer uses the frame 46 as a rough guide, abutting the cutting implement against the outer perimeter 48 of the frame 46 or otherwise following the outer perimeter 48 to cut around the pre-existing fenestration unit 44. As shown in FIG. 3, in some embodiments, an angle grinder 130 is used with a diamond abrasive wheel to cut through the finished exterior 16 (e.g., stucco). After the finished exterior 16 is cut, as shown in FIG. 4, a circular saw 140 is optionally used through the cut in the finished exterior 16 to cut to a desired depth through the nailing fin 50 (FIG. 1B) of the pre-existing fenestration unit 44. Finally, as shown in FIG. 5, a reciprocating saw 150 is optionally used to connect and/or finish the cuts through the finished exterior 16 and/or nailing fin 50 (FIG. 1B) about the perimeter at the corners, helping to ensure a clean (e.g., less ragged, more uniform) cut about the rough opening 12 (FIG. 1A). If desired, a vacuum (not shown) with a HEPA filter is used during various cutting steps to minimize dust (e.g., generated using the angle grinder, circular saw, etc.).

Once the nailing fin 50 has been cut and/or other fastening means (such as screws) have been cut from around the pre-existing fenestration unit 44, the pre-existing fenestration unit 44 is released from the rough opening 12 and can be removed and disposed of properly. Note, in some embodiments, the nailing fin 50 remains embedded under the finished exterior 16 following removal of the pre-existing fenestration unit 44. In at least this manner, various embodiments help avoid removing surrounding portions of the finished exterior 16 that would otherwise need to be removed (and subsequently repaired) in order to access the nailing fin 50. After removing the pre-existing fenestration unit 44, the rough opening 12 is cleaned and any rotted or damaged portions of the substructure 14 are repaired or replaced as desired. If present, any house wrap or other barrier material is trimmed flush with the exterior of the rough opening 12 or as desired.

Figure 6:
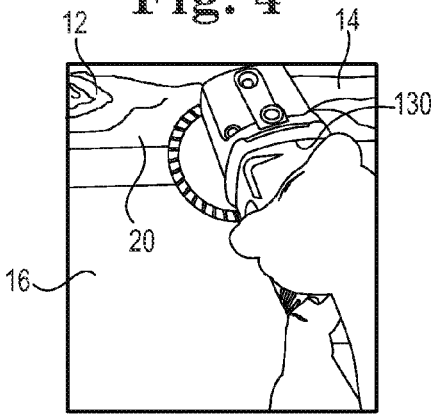

In some embodiments, the finished exterior 16 is repaired (e.g., stucco is patched) if there is any collateral damage while removing the pre-existing fenestration unit 44 (e.g., if the reciprocating saw caught on the wire lath in a stucco application causing damage to the stucco finish). As shown in FIG. 6, in some embodiments, the sill 20 and jambs 24, 26 of the rough opening 12 are prepared by cutting the finished exterior 16 along the sill 20 and jambs 24, 26 as necessary to help ensure the finished exterior 16 does not project beyond the substructure 14 (above the sill 20 and inward of the jambs 24, 26). In other words, the finished exterior 16 is generally cut flush with the substructure 14. The substructure 14 is cleaned (e.g., all dust and debris is vacuumed and the sill framing is wiped with isopropyl alcohol, a window cleaner, or other cleanser as desired). The head 22 is optionally similarly prepared, with the finished exterior 16 being cut flush to the substructure 14 and cleaned as desired.

Figure 7:
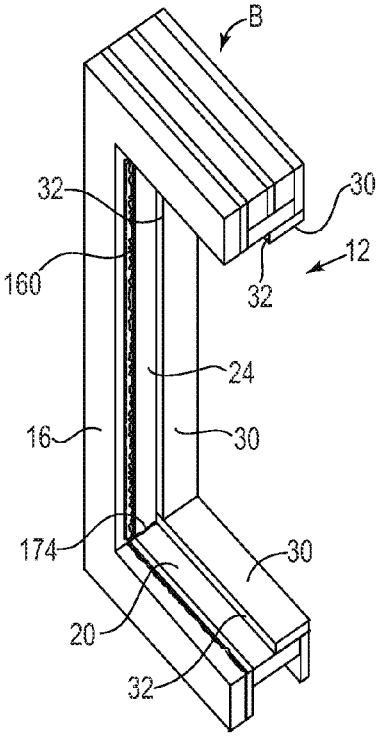
FIGS. 7-10 show the rough opening during various stages of preparation for installation of a replacement fenestration unit in the rough opening, according to some embodiments.
Figure 7A:
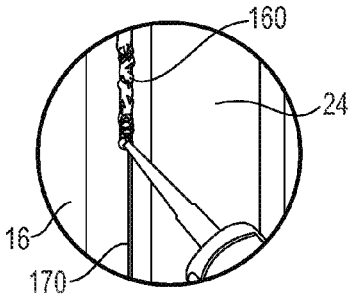
Figure 7B:
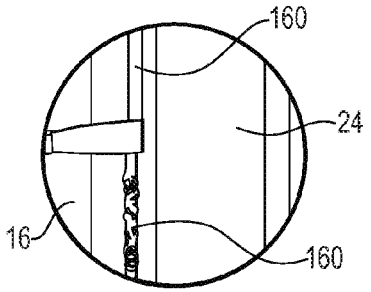

FIG. 7 is a cross-section of a selected portion of the building B, showing about half of the rough opening 12. In some embodiments, the rough opening 12 is prepared for installation of the fenestration unit 40 by applying the liner system 70 and the barrier system 72 (FIG. 1A). As shown in FIGS. 7 and 7A, some methods of preparing the rough opening 12 at the sill 20 include applying a perimeter sealant 160 (e.g., an approximately 0.375 inch wide bead of sealant) between the finished exterior 16 and the rough opening 12 at the jambs 24, 26 and the sill 20. In particular, in some embodiments, there is a space 170 or gap between the finished exterior 16 and the substructure 14 (e.g., where the finished exterior 16 is a stucco finish) that is exposed upon cutting the pre-existing fenestration unit 44 free from the rough opening 12. In some embodiments, sealant is not applied in the gap or space at the head 22. As shown in FIG. 7B, the perimeter sealant 160 is optionally tooled into the space 170 between the finished exterior 16 and the rough opening 12 (e.g., with a putty knife or other implement, such as a scrap shim) as desired to press the perimeter sealant 160 into the space 170. As shown in FIG. 7, in some embodiments, a corner sealant 174 (e.g., an approximately 0.375 inches wide bead of sealant) is placed at each corner of the rough opening 12, with the corner sealant 174 extending from the finished exterior 16 to the exterior edge 32 of the drywall return 30 or to the interior edge of the substructure 14 (one of the corners at the sill 20 is shown with the corner sealant 174 applied up to the drywall return 28 in FIG. 7).

Figure 8:
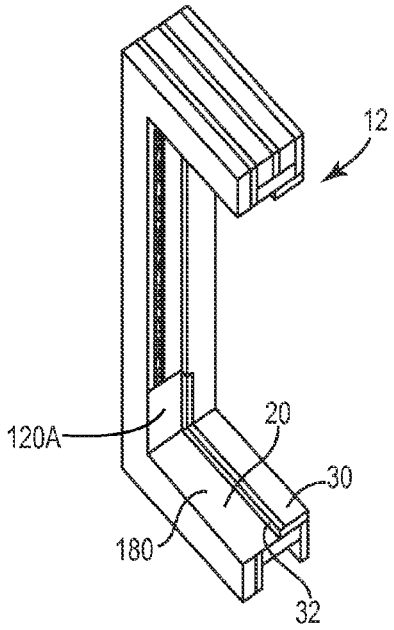
Figure 10:
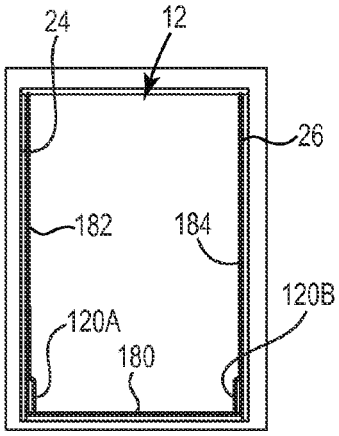

As indicated in FIGS. 8 and 10, in some embodiments, the flashing 120 (FIG. 1A) includes a sill flashing 180 a first jamb flashing 182, and a second jamb flashing 184. As indicated in FIGS. 8 and 10, the sill flashing 180, or bottom flashing, is applied to the sill 20 of the rough opening 12. For example, the sill flashing 180 is optionally formed from a strip of flashing tape such as that previously described that is cut longer than the width of the rough opening 12 (e.g., approximately 12" longer) to define excess tape ends 120A, 120B, where the excess tape ends 120A, 120B are applied up the first and second jambs 24, 26 (e.g., approximately 6" of excess flashing extending up the first and second jambs 24, 26). An exterior edge 190 of the sill flashing 180 is applied along the edge of the finished exterior 16, with the sill flashing 180 being pressed down firmly over the perimeter and corner sealant 174, the exposed substructure 14 at the sill 20 and the jambs 24, 26, the exterior edge 32 of drywall return 30, and onto the exposed surface of the drywall return 30.

Figure 9:
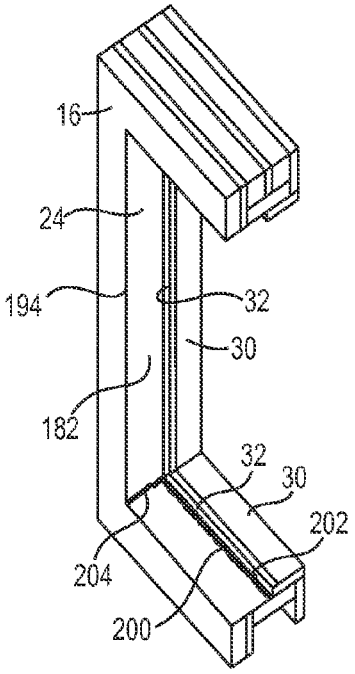

The first and second jamb flashings 182, 184 are optionally formed by cutting two pieces of flashing tape approximately equal to the height of the rough opening 12. As indicated in FIGS. 9 and 10, exterior edges of the jamb flashings 180, 182 (exterior edge 194 of first jamb flashing 182 is shown in FIG. 9) are placed along the edge of the finished exterior 16 along the first and second jambs 24, 26. The jamb flashings 182, 184 are pressed down firmly over the sealant perimeter sealant, the exposed substructure 14 at the jambs 24, 26, the exterior edge 32 of drywall return 30, and onto the exposed surface of the drywall return 30.

As indicated in FIG. 9, a sill sealant 200 (e.g., an approximately 0.375 inches bead of sealant), including a first portion 202 applied across the sill 20 on top of the sill flashing 180, against the exterior edge 32 of the drywall return 30, corner portions 204 applied at the corners of the rough opening 12 where the sill 20 meets the first and second jambs 24, 26 (only the corner portion 204 at the first jamb 24 is shown in FIG. 9).

As appropriate, a filler strip 210 is cut to a desired length and width and installed at the sill 20. For example, a wood or expanded PVC filler strip 210 is optionally produced by measuring from the exterior face of the finished exterior 16 to the exterior edge 32 of the drywall return 30 and by subtracting approximately 1.625 inches to determine an appropriate width for the filler strip 210. The filler strip 210 is approximately 0.5 inches thick and is cut to the same length as the sill 20 at the determined width. The filler strip 210 is installed on top of the sill sealant 200 (FIG. 9) applied on top of the sill flashing 180. The filler strip 210 is optionally attached to the sill 20 with fastening means, such as #8×1.5 inch flat head wood screws, where the screws are placed approximately 6" from the ends of the filler strip 210 and a maximum of approximately 16" apart on center.

Figure 11:
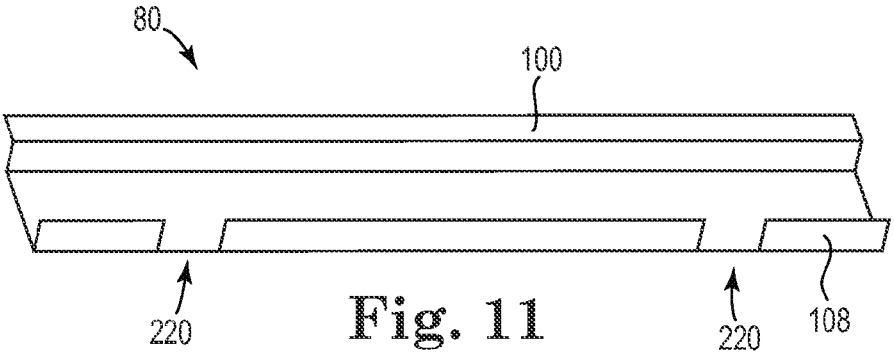
FIGS. 11-13 are illustrative of a sill liner of the replacement installation of FIG. 1A, as well as preparation of the rough opening and installation of the sill liner in the rough opening, according to some embodiments.

The sill liner 80 is shown in perspective in FIG. 11, according to some embodiments. The sill liner 80 is optionally prepared by cutting the liner material 100 to a length that is approximately the width of the rough opening 12. In some embodiments, a single, continuous length of liner material 100 is utilized to form the sill liner 80 (rather than splicing multiple lengths of the liner material 100, for example), to help ensure integrity of the water resistance of the sill liner 80. A plurality of drainage ports 220 (e.g., two as shown in FIG. 11) are cut into the sill liner 80 as desired. For example, in some embodiments a 1" wide drainage port 220 is cut into the first flange 108 of the sill liner 80 approximately 2" from each end of the sill liner 80. For each port 220, snips are optionally used to make two cuts in the face of the sill liner 80 and then pliers are used to bend the resulting tab, thereby breaking off the tab to form the respective drainage port 220.

Figure 12:
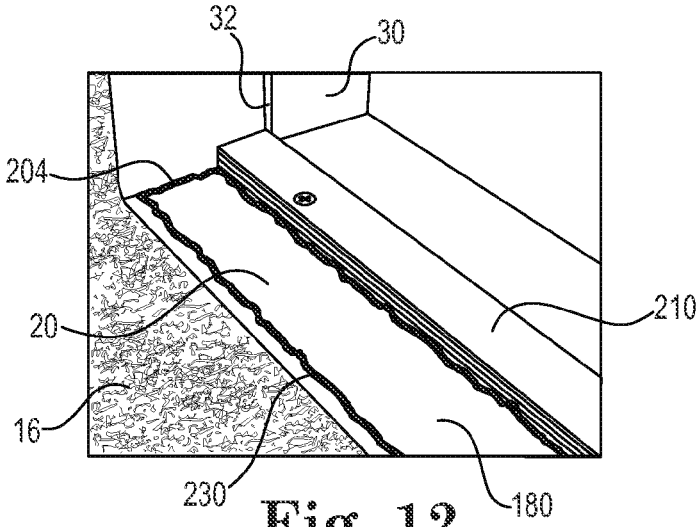

As part of installing the sill liner 80, in some embodiments, a secondary sealant 230 is applied as shown in FIG. 12 (e.g., two bead lines of 0.375 inch sealant) across the sill 20 (and in particular, on top of the sill flashing 180) joining the first and second side portions of the sill sealant 200 located at the ends of each of the first and second jambs 24, 26.

Figure 13:
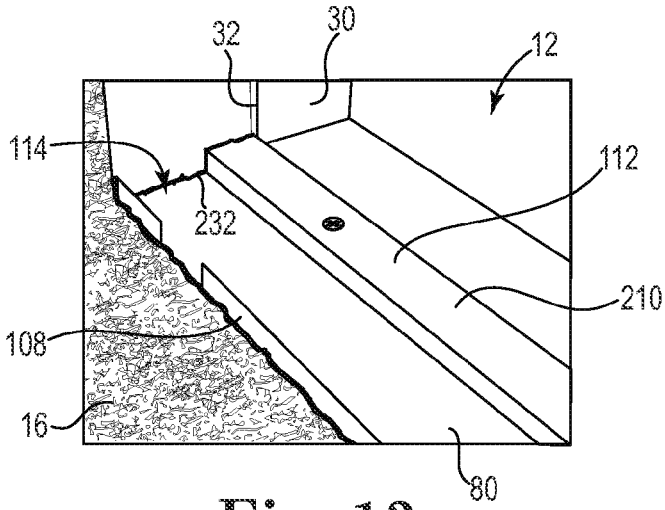

As shown in FIG. 13, the sill liner 80 is installed over the secondary sealant 230 (FIG. 12) and attached to the sill 20 as desired (e.g., using 1.25" self drilling screws through the second base 112 into the filler strip 210 (FIG. 12) and disposed a maximum of 6" from each end and 12" from one another on center). The sill liner 80 is positioned with the first flange 108 flush with the exterior surface of the finished exterior 16 and the second base 112 over the filler strip 210, such that the channel 114 is facing upward toward the center of the rough opening 12. In some embodiments, a liner sealant 232 (e.g., an approximately 0.375 inch bead) to each end of the sill liner 80 to seal the sill liner 80 to the jambs 24, 26 and sill 20. Any gaps along the exterior joint between the sill liner 80 and the finished exterior 16 are filled with sealant as desired (e.g., including tooling sealant into any such gaps as desired).

Figure 14:
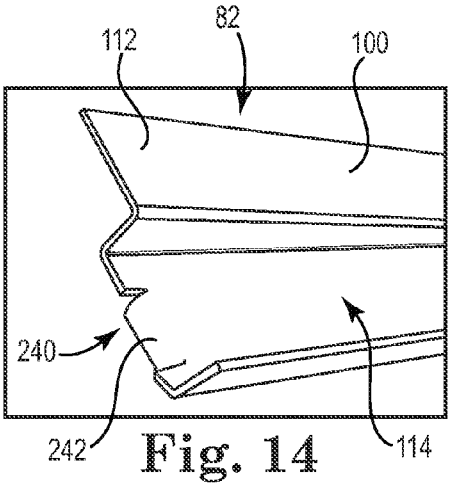
FIGS. 14-18 are illustrative of a head liner of the replacement installation of FIG. 1A, as well as preparation of the rough opening and installation of the head liner in the rough opening, according to some embodiments.

An end portion of the head liner 82 is shown in perspective in FIG. 14, according to some embodiments. The head liner 82 is optionally prepared by cutting the liner material 100 to a length that is approximately the width of the rough opening 12. In some embodiments, a single, continuous length of the liner material 100 is utilized to form the head liner 82 (rather than splicing multiple lengths of material, for example), to help ensure integrity of the water resistance of the head liner 82. Connection ports 240 are formed at each end of the head liner 82, where one of the connection ports 240 is shown in FIG. 14. In some embodiments, the connection ports 240 are formed by cutting a 0.25 inch deep by 0.75 inch wide tab 242 into the first base 102 at each end of the head liner 82 (e.g., using snips) and bending the tab 242 downwardly to form the particular connection port 240.

Figure 15:
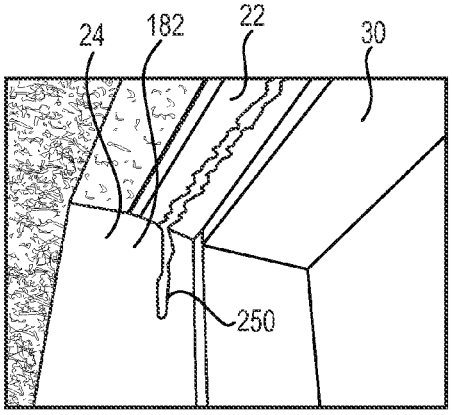
Figure 16:
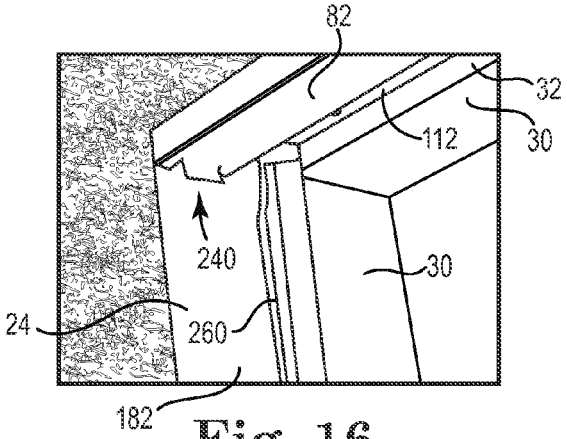
Figure 17:
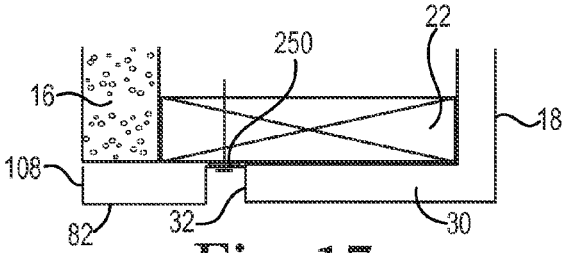
Figure 18:
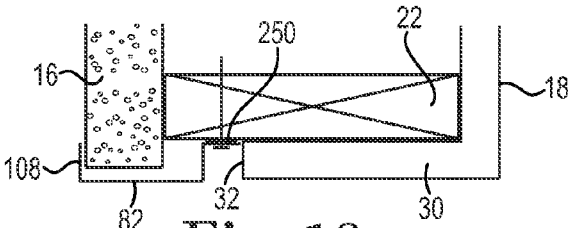

As shown in FIG. 15, in some embodiments, a head sealant 250 is applied across the head 22 of the rough opening 12, in front of the drywall return 30, and down onto the upper portions of the first and second jambs 24, 26 (and in particular, onto the first and second jamb flashings 182, 184). For example, an approximately 0.375 wide bead of sealant is optionally applied across the head 22 of the rough opening 12 and down approximately 1 inch onto the jambs 24, 26 prior to installing the head liner 82. As shown in FIG. 16, the head liner 82 is installed over the head sealant 250 with the channel 114 (FIG. 14) facing away from the center of the rough opening 12, toward the head 22 and the second base 112 against the head and head sealant 250. The head liner 82 is attached to the head 22 (e.g., using screws or other fastening means through the second base 112 as previously described). In some embodiments, each end of the head liner 82 is sealed to the jambs 24, 26 (e.g., by running sealant around the ends of the head liner 82) while leaving the area around the tabs 242 on the head liner 82, and in particular the connection ports 240, unsealed. The head liner 82 is optionally installed with the first flange 108 flush with the finished exterior 16 (e.g., as shown in FIG. 17) similarly to the sill liner 80. In other embodiments the head liner 82 projects beyond the edge of the finished exterior 16 and is overlapped onto the exterior face of the finished exterior 16 (e.g., where the stucco is not flush with the rough opening, e.g., as shown in FIG. 18).

In some embodiments, the first and second jamb liners 84, 86 are cut from the liner material 100 to approximately 1" less than the height of the rough opening 12. As shown in FIG. 16, a jamb sealant 260 is applied to the first jamb 24 (and in particular, to the first jamb flashing 182), as well as the second jamb 26 (and in particular, the second jamb flashing 184, though not shown in FIG. 16), where application of the jamb sealant 260 optionally includes applying an approximately 0.375 inch bead of sealant down each of the jambs 24, 26 in front of the drywall return 30.

Figure 19:
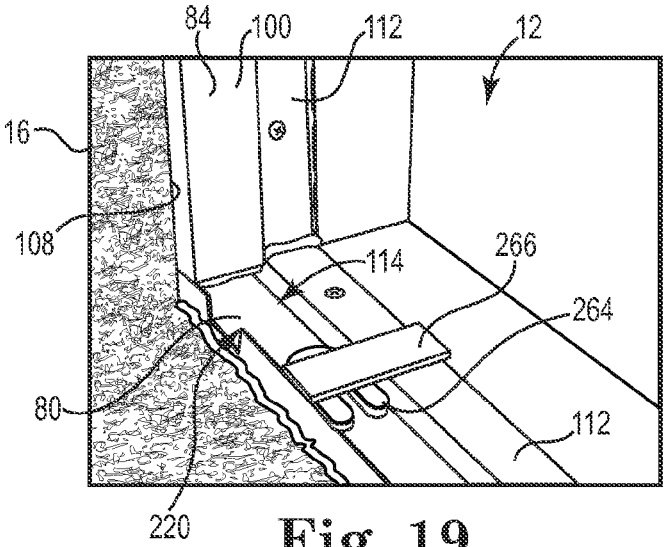
FIG. 19 shows spacers installed on the sill liner, according to some embodiments.

As indicated in FIG. 19, the first jamb liner 84 is positioned on the first jamb 24 with the first flange 108 flush to the finished exterior 16 and the channel 114 facing toward the first jamb 24 such that the channel 114 of the first jamb liner 84 is aligned with a corresponding one of the connection ports 240 of the head liner 82, as well as with the channel 114 of the sill liner 80. The second jamb liner 86 is similarly positioned on the second jamb 26. The first and second jamb liners 84, 86 are attached to the first and second jambs 24, 26, respectively (e.g., using 1.25 inch self-drilling screws through the second base 112 and placed approximately 6" from each end and 12" on center from one another).

In some embodiments, the jamb liners 84, 86 are sealed at the interior corners where the bottom of the respective one of the jamb liners 84, 86 meets the sill liner 80. In other words, additional sealant is optionally applied at the corners of the rough opening 12, where the second base portions 112 of the jamb liners 84, 86 and the sill liner 80 meet (e.g., FIG. 19 shows sealant at the corner between the base portions 112 of the first jamb liner 84 and the sill liner 80). If the head liner 82 or jamb liners 84, 86 include splices (i.e., multiple, discontinuous portions of the liner material 100) additional flashing 120 is optionally over the splices to help ensure water integrity.

During and at the end of installation, the installer periodically inspects the installation to verify that water will be able to travel from the channel 114 of the head liner 82, into the channel 114 of the jamb liners 84, 86, down into the channel 114 of the sill liner 80, and exit from the drainage ports 220.

As shown in FIG. 19, in some embodiments, spacers are positioned on the sill liner 80 as a part of the installation process. For example, one or more liner spacers 264 (e.g., 0.5 inch impervious spacers) are installed in the channel 114 of the sill liner 80 (e.g., approximately 1" from each side). The liner spacers 264 are positioned to allow water flowing down the jamb liners 84, 86 to flow to, and out of, the drainage ports 220. If desired, support spacers 266 (e.g., 1 inch×0.25 inch spacers) are placed on top of the liner spacers 264. Support spacers and/or shims may also be implemented at points where multiple fenestration units are joined together (not shown). Shims are added as desired to help ensure the spacers are level, where the shims are trimmed to help ensure a continuous interior seal when completing the installation.

Figure 20:
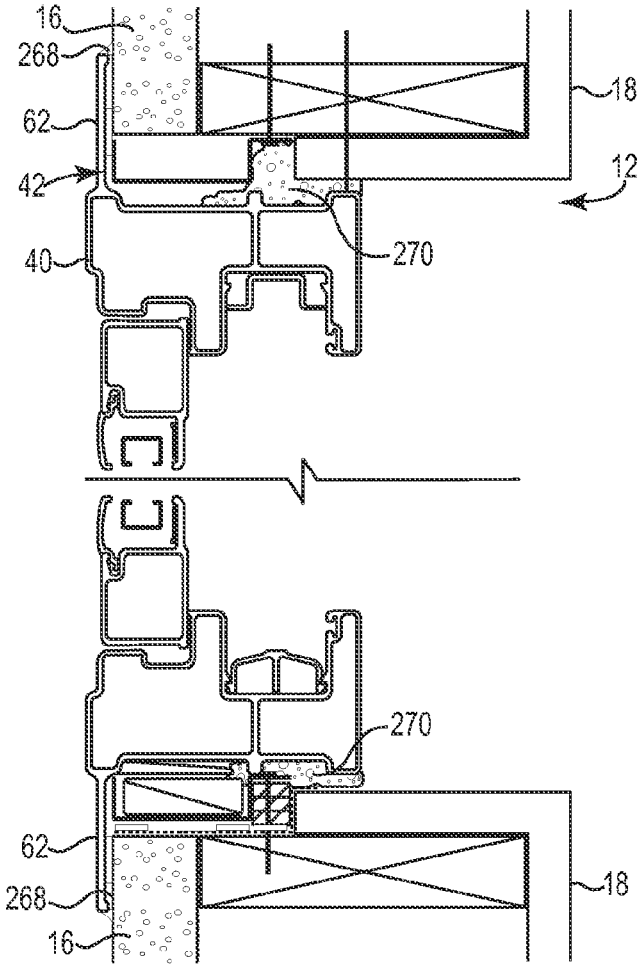
FIG. 20 shows a replacement fenestration unit installed in the rough opening, according to some embodiments.

As shown in FIG. 20, with the water management system 42 installed, the fenestration unit 40 is inserted into the prepared rough opening 12 (e.g., with the frame 60 positioned in the rough opening 12 and the flange 62 adjacent the finished exterior 16). The fenestration unit 40 is optionally secured to the rough opening 12 using the manufacturer's recommendations and/or traditional window insert installation methods, including application of fenestration unit sealant 268 and insulating foam 270 about the perimeter of the fenestration unit 40 as shown in FIG. 20, for example.

While FIGS. 1-20 generally illustrate installation of a window assembly, according to some embodiments, it should be understood that other fenestration unit installations, door assembly installations, for example, are also contemplated. For example, FIGS. 21A-31 are illustrative of door installation methodology for a replacement installation 310 in a rough opening 312 in a building structure B formed by a substructure 314 (also described as a framing) defining the rough opening 312, a finished exterior 316 on an exterior side E of the building B, and a finished interior 318 on an interior side I of the building B, according to some embodiments. FIG. 21A shows an installation without a sill nosing material and FIG. 21B shows an installation with a sill nosing, according to some embodiments, as subsequently described.

The pre-existing fenestration unit is optionally removed from the rough opening 312 using similar methodology to that previously described—e.g., including cutting around a perimeter of the pre-existing fenestration unit without removing a significant portion of the finished exterior 316 of the building B.

Figure 21B:
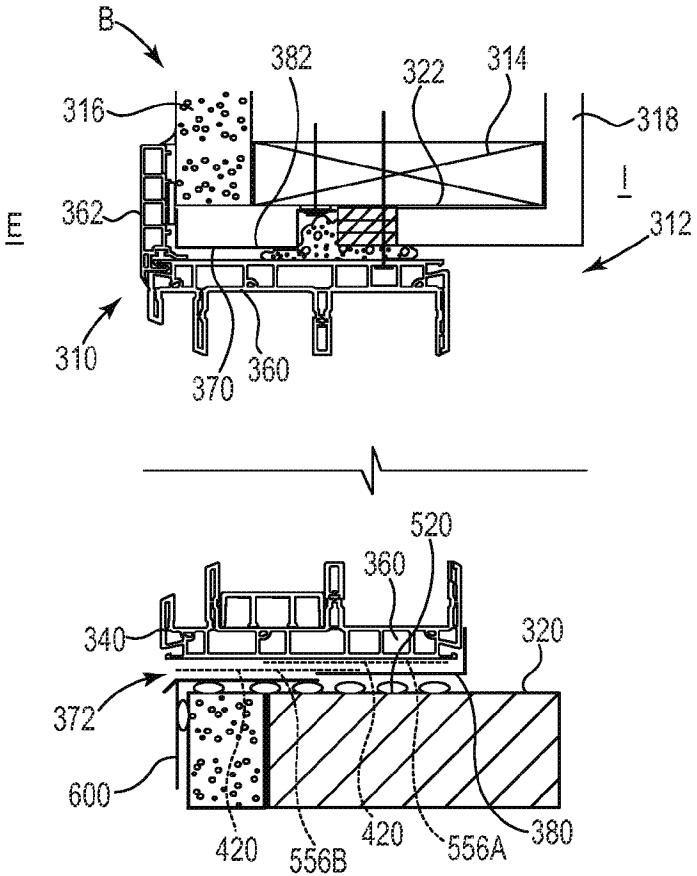
FIGS. 21A-31 are illustrative of another replacement installation, according to some embodiments.
Figure 21A:
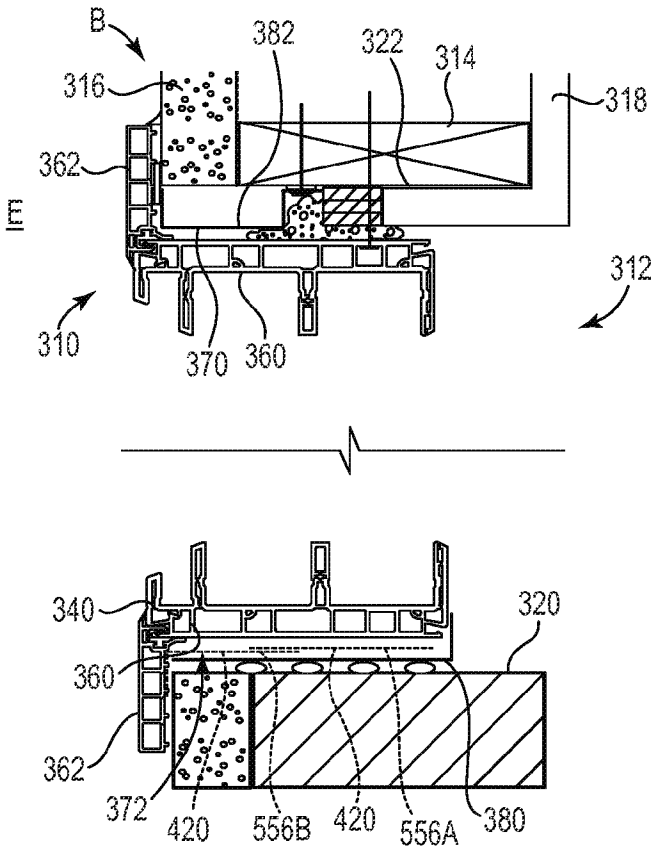

As shown in FIGS. 21A and 21B, the substructure 314 defines various portions of the rough opening 312, including a sill 320, a head 322 opposite the sill 320, a first jamb 324 (FIG. 22), and a second jamb (not shown) opposite the first jamb 324. In some embodiments, the finished exterior 316 is a stucco finish (e.g., including a weather barrier, metal lath, one or more plaster layers, and/or other materials), though alternate or additional finished exteriors are contemplated (e.g., brick, tile, or other finished surfaces). The interior 318 optionally includes a layer of drywall and/or other materials (e.g., vapor barrier material). A drywall return 330 (or other material) defining an exterior edge 332 is optionally secured to the sill 320, head 322, the first jamb 324, and the second jamb as desired.

As shown in FIGS. 21A and 21B, the replacement installation 310 includes a fenestration unit 340 and a water management system 342. In some embodiments, the replacement installation 310 is provided as part of a method of replacing a pre-existing fenestration unit (not shown) previously installed in the rough opening 312 of the substructure 314.

As shown in FIGS. 21A and 21B, the fenestration unit 340 is a door unit having a frame 360 and a flange 362. During installation, the frame 360 is received in the rough opening 312 with the flange 362 abutting or residing adjacent portions of the finished exterior 316 and/or substructure 314, for example. FIG. 21A shows a door unit having the flange 362 on all four sides and FIG. 21B shows a door unit having the flange 362 on three sides (as shown, not on the bottom end of the door unit).

The water management system 342 includes a liner system 370 and a barrier system 372. The liner system 370 includes a sill pan 380, a head liner 382, a first jamb liner 384 (FIG. 31), and a second jamb liner (not shown). In some embodiments, the head liner 382, the first jamb liner 384, and the second jamb liner are each formed during installation from substantially the same preformed liner material (though not necessarily the same piece of liner material), such as the segment of the liner material 100 shown in FIGS. 2A and 2B.

As shown in FIGS. 21A and 21B, the barrier system 372 includes flashing 420 to help reduce the potential for water ingress into the interior side I of the building B. The flashing 420 is optionally flashing tape, such as butyl flashing tape sold under the trade name "SMARTFLASH," by Pella Corporation of Pella, Iowa. The barrier system 472 also optionally includes various sealant layers, applied as a liquid by the installer as previously described.

Figures 23A, 23B, 23C:
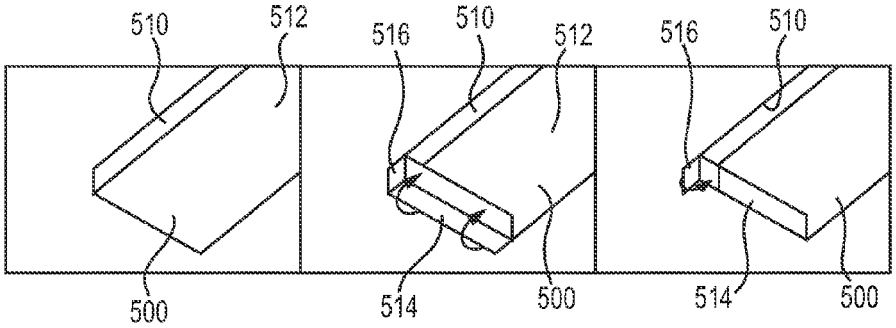

As shown in FIGS. 23A-23C, a method of replacing the existing fenestration unit (not shown), or pre-existing fenestration unit, includes using sill pan material 500 to construct the sill pan 380. The sill pan material 500 is optionally an elongate length of material having a substantially L-shaped cross-section with the back flange 510, or vertical leg, and a base 512, or horizontal leg. Sill pan construction optionally includes measuring the width of the rough opening 312, adding approximately 2" to that width to get the desired length, and cutting the sill pan material 500 to that length. The installer measures inward approximately 1" from each end of the sill pan material 500 and cuts through the back flange 510 of the pan material 500 at each end, resulting in side flaps 514 (one of which is shown in FIG. 23B) and back legs 516 (one of which is shown in FIG. 23B). Each of the resulting side flaps 514 are bent up and the remaining back legs 516 are bent around the side flaps 514 to form the ends of the sill pan 380. The sill pan 380 is then test fit in the rough opening 312 to ensure the sill pan 380 is of an appropriate size.

Figure 22:
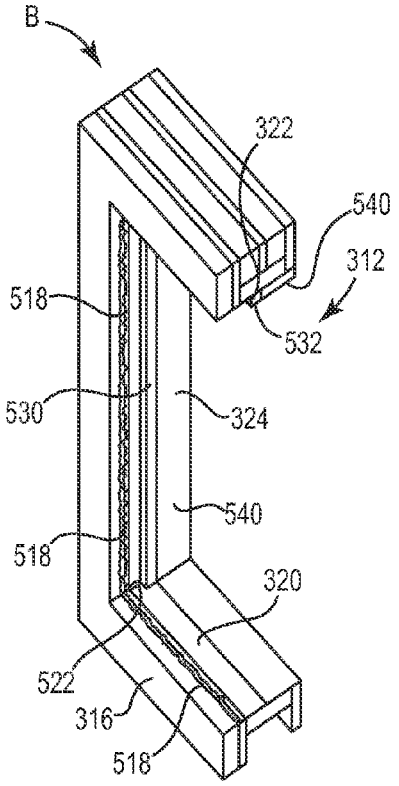

FIG. 22 shows a portion of the rough opening 312 in the building B that has been partially prepared for installation of the replacement fenestration unit 340 (FIGS. 21A and 21B), according to some embodiments. As shown, gaps between the finished exterior 316 and the rough opening 320 are filled with gap sealant 518.

Figure 24:
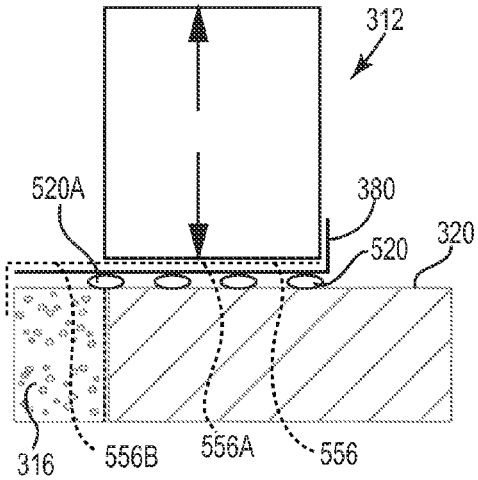

As shown in FIG. 24, a sill sealant 520 is applied (e.g., four generally parallel lines of an approximately 0.375 inch bead of sealant) across the sill 320, where at least a part 520A of the sill sealant 520 (e.g., one of the lines of sealant) covers the gap between the finished exterior 316 and the sill 320. As shown in FIG. 22, a sill corner sealant 522 (e.g., a 0.375 bead of sealant) is applied at each corner of the sill 320. As shown in FIG. 24, the sill pan 380 is installed on the sill 320 of the rough opening 312 and pressed down to seal the sill pan 380 to the sill 320 of the rough opening 132.

As shown in FIG. 22, in some embodiments, a jamb filler strip 530 is cut for the first jamb 324 and a second jamb filler strip (not shown) is cut for the second jamb and a head filler strip 532 is cut for the head 322. In some embodiments, the filler strips are approximately 0.5 inch thick wood or expanded PVC filler strips. In some installations, the width of the various filler strips is determined by measuring a distance from the outer surface of the stucco to an exterior edge of a drywall return 540 at the first jamb 324, second jamb, and the head 322 and subtracting approximately 2" from that distance. In some embodiments, the filler strips 530, 532 are placed against the edge of the drywall return 540 at the jambs and head of the rough opening 312. The filler strips 530, 532 are optionally installed using fastening means, such as #8×1.5 inch wood screws at 16" on center maximum spacing from one another.

As shown in FIG. 22, similarly to the methodology previously described in association with the fenestration unit 40, the gap sealant 518 (e.g., a 0.375 inch bead of sealant) is applied between the finished exterior 316 and the rough opening 312 at the first jamb 324 and the second jamb, leaving the gap between the finished exterior 316 and the head 322 relatively free from sealant. The gap sealant 518 is optionally tooled into the gap between the finished exterior 316 and the rough opening (e.g., with a putty knife).

In some embodiments, sill flashing 556 is applied over the finished exterior 316 and the sill pan 380 as shown in FIG. 24. For example, two pieces of flashing tape, a first piece of flashing 556A and a second piece of flashing 556B, are cut 12" longer than the width of the rough opening 312, where the first piece 556A is disposed across the sill pan 380 with the exterior edge of the first piece 556A overlapping onto the finished exterior 516 approximately 1" and extending approximately 6" up each of the first jamb 524 and the second jamb. The second piece 556B of flashing tape is applied over-lapping the first piece 556A with the interior edge of the second piece 556B positioned along the interior corner of the sill pan 380 and approximately 6" up each of the first jamb 524 and second jamb 526.

In some embodiments, jamb flashing (not shown) is also applied over the finished exterior 516 and the first jamb 524 and the second jamb. For example, two pieces of flashing tape are cut equal to the height of the rough opening 312 with the exterior edge of each of the pieces of tape being placed along the exterior edge of the finished exterior 316, the pieces of tape being pressed down over any jamb sealant, exposed substructure 314, along the edge of the drywall return 540, and over onto the edge of the drywall return 540.

Figure 25:
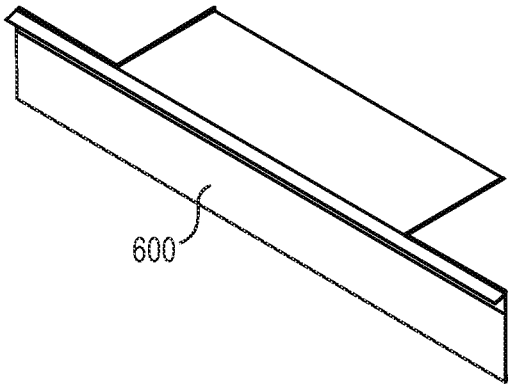
Figure 26:
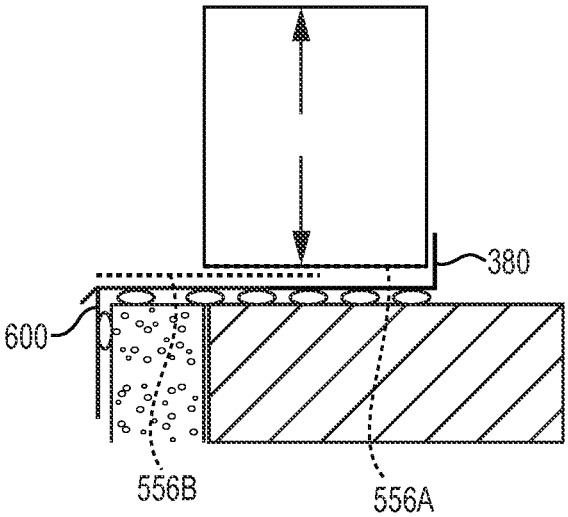
Figure 27:
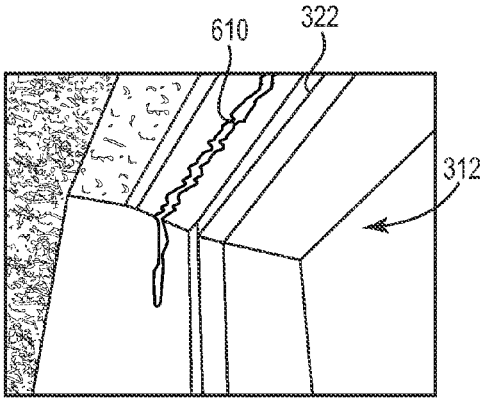
Figure 28:
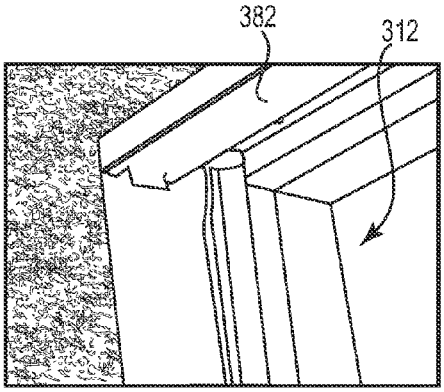

While the sill pan 380 is optionally applied as shown in FIG. 21A, as shown in FIGS. 21B, 25 and 26, in some embodiments, a sill nosing 600 is also applied as part of the installation process (e.g., in the instance of a three-sided, flush flange sill door installation). For example, the sill nosing 600 is optionally cut to the width of the rough opening 316 plus two times the width of the flange 362 of the fenestration unit 340 (FIG. 21B). Where the sill nosing 600 is applied, as shown in FIG. 21B, a narrower sill pan 380 is used and the sill sealant 520 is applied across the sill 320 of the rough opening sill and finished exterior 316 (e.g., seven lines of approximately 0.375 inch beads of sealant), where it is ensured that the sill sealant 520 covers the gap between the stucco and the sill 320 of the rough opening 312 and the sill sealant 520 is applied where the sill pan 380 will sit, as well as in front of the sill pan 380 and onto the finished exterior 316 over which the sill nosing 600 will reside upon installation thereof. The sill sealant 520 is also applied at each corner of the rough opening 312 from the finished exterior 316 to the edge of the rough opening 312, according to some embodiments. The sill pan 380 and the sill nosing 600 are then applied at the sill 320 and are pressed down into the sill sealant 520. In some embodiments, fasteners are used to secure the sill pan 380 and sill nosing 600 in the rough opening 312.

With the sill nosing 600, in some embodiments, the sill flashing 556 is formed by cutting the two pieces 556A, 556B of flashing (e.g., flashing tape) 12" longer than the width of the rough opening 312, placing the first piece 556A across the sill nosing 600 just up to where the sill nosing 600 begins to slope down and extending 6" up each of the first jamb 324 and the second jamb, and placing the second piece 556B overlapping the first piece 556A and the exterior edge of the sill pan 302 and approximately 6" up of the jambs. Jamb flashing is optionally formed and applied as previously described.

Whether the sill is prepared with the sill pan 380 or with the sill pan 380 and sill nosing 600, in some embodiments, the head 322 is prepared as shown in FIGS. 27-30. The head liner 382 is prepared similarly to the head liner 82 (e.g., at each end of the head liner 382 a connection port is formed) and the head liner 382 is sealed to the head 322 of the rough opening 312 by applying a head sealant 610 across the head 322 of the rough opening 312. For example, an approximately 0.375 inch bead of sealant is applied across the head 322 of the rough opening and approximately 1 inch down onto the jambs prior to installing the head liner 382.

Figure 29:
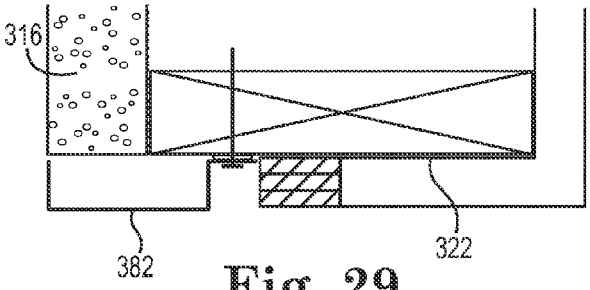
Figure 30:
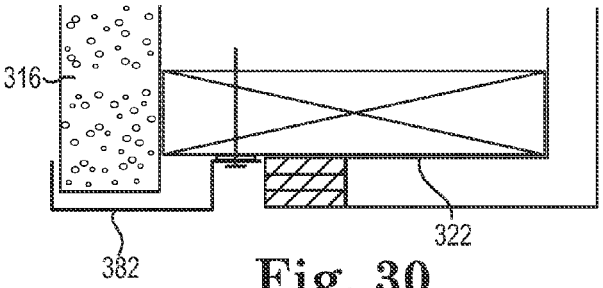

The head liner 382 is installed over the head sealant 610 and attached to the head 322 of the rough opening 312 (e.g., 1.25 inch self-drilling screws are placed through the head liner 6" from each end and 12" on center). Each end of the head liner 382 is sealed to the first and second jambs, although the connection portions on the head liner 382 are not sealed. The head liner 382 is either positioned generally flush with the finished exterior 316 as shown in FIG. 29 if the finished exterior 316 is flush with the rough opening 312 or is overlapped over the finished exterior 316 as shown in FIG. 30 if the finished exterior 316 is not flush (e.g., projects beyond) the rough opening 312 at the head 322.

Figure 31:
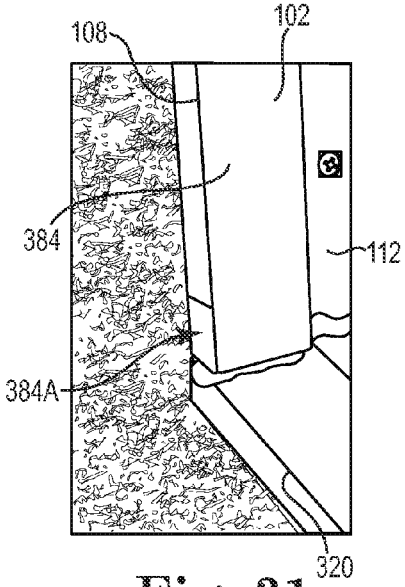

In some embodiments, a jamb sealant is applied along the each of the jambs prior to installing the first jamb liner 384 as shown in FIG. 31, and the second jamb liner. The first jamb liner 384 and second jamb liner are optionally formed by cutting the liner material 100 to approximately 0.5 inch less than the height of the rough opening 312 and notching the first flange 108 to form exterior openings 384A adjacent the sill 320. The first jamb liner 384 and second jamb liner are optionally secured to the first and second jambs, respectively, using fasteners such as those previously described, where the first base 102 of each of the jamb liners faces toward a center of the rough opening and the second base 112 of each of the jamb liners is secured to the respective jamb (e.g., using fasteners such as those previously described). The channels 114 of each of the jamb liners are aligned to the connection ports on the head liner 382 such that water flowing in the head liner 382 runs down into the first jamb liner 384 and second jamb liner and out of the exterior openings 384A in the jamb liners.

A final sealant is optionally applied, where the first jamb liner 384 and the second jamb liner are sealed to the first jamb 324 and the second jamb, respectively. In some embodiments, sealant is applied completely across the tops of the jamb liners, where the jamb liners meet the head liner 382. The entire inside edge of the sill liner 380 is optionally sealed to the sill nosing 600 or the sill pan 380 as appropriate. A final check is made to ensure that water is able to exit from the exterior notches in each of the jamb liners. Any liner splices are covered with flashing tape and the fenestration unit installation is then completed by installing the fenestration unit 340 (FIGS. 21A and 21B) in the prepared rough opening 312.

The foregoing embodiments provide an effective and efficient means for installing a replacement fenestration unit in an application where the existing fenestration unit is removed from the corresponding structure by cutting around a perimeter of the existing fenestration unit (e.g., rather than removing substantial portions of the finished exterior, such as a stucco finish, of the structure). Various modifications and additions can be made to the exemplary embodiments discussed without departing from the scope of the present invention. For example, while the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof.

We claim:

1. A water management system for installation in a frame including a first jamb member, a second jamb member, a head member, and a sill member, the first and second jamb members, the head member, and the sill member defining a rough opening in a building structure having an exterior side and an interior side, the system comprising:

a sill liner adjacent the sill member of the rough opening and including a sill liner channel that faces upward toward the rough opening;

a head liner adjacent the head member of the rough opening and including a head liner channel faces upward away from the rough opening, the head liner including first and second connection ports at each end of the head liner channel;

a first jamb liner adjacent the first jamb member of the rough opening and including a first jamb liner channel aligned with the sill liner channel and the first connection port of the head liner channel such that fluid can flow from the head liner channel to the first jamb liner channel via the first connection port and from the first jamb liner channel to the sill liner channel; and a second jamb liner adjacent the second jamb member of the rough opening and including a second jamb liner channel aligned with the sill liner channel and the second connection port of the head liner channel such that fluid can flow from the head liner channel to the second jamb liner channel via the second connection port and from the second jamb liner channel to the sill liner channel.

2. The system of claim 1, wherein the first jamb liner defines an upper end and a lower end and the head liner defines a first lateral end and a second lateral end, the first lateral end of the head liner being engaged with the upper end of the first jamb liner.

3. The system of claim 1, wherein the head liner has a cross-section that is substantially the same as a cross-section of the first jamb liner, the head liner including a first landing extending between a first end and a second end, a first wall extending from the first end of the first landing and a second wall extending from the second end of the first landing, the head liner channel defined between the first and second walls, and a second landing extending from the second wall, the first and second landings being vertically offset from one another.

4. The system of claim 3, wherein the first connection port is formed into the first landing at the first lateral end of the head liner.

5. The system of claim 1, wherein the first jamb liner defines an upper end and a lower end and the first jamb liner has a slot formed into the first wall at the lower end of the jamb liner.

6. The system of claim 1, wherein the sill liner has a cross-section substantially the same as the cross-section of the jamb liner, and includes a first landing extending between a first end and a second end, a first wall extending from the first end of the first landing and a second wall extending from the second end of the first landing, the sill liner channel defined between the first and second walls, and a second landing extending from the second wall, the first and second landings being vertically offset from one another.

7. The system of claim 6, further comprising a removable spacer disposed in the channel in the sill liner.

8. The system of claim 6, wherein the sill liner includes a drainage port formed into the first wall of the sill liner, the sill liner being configured such that water in the channel in the sill liner flows from the drainage port of the sill liner.

9. The system of claim 6, wherein the first jamb liner defines an upper end and a lower end and the lower end of the first jamb liner is engaged with the first landing of the sill unit.

10. The system of claim 1, wherein the system is installed in a building having a finished exterior including stucco material.

11. The system of claim 10, wherein the system is installed in the building with sealant between the stucco material and the jamb liner.

12. The system of claim 11, wherein the system is installed in the building with the stucco material and the head liner defining an open gap therebetween.

13. A water management system for installation in a frame including a first jamb member, a second jamb member, a head member, and a sill member, the first and second jamb members, the head member, and the sill member defining a rough opening in a building structure having an exterior side and an interior side, the system comprising:

a sill liner configured to be positioned adjacent the sill member of the rough opening and including a sill liner channel that faces upward toward the rough opening;

a head liner having first and second ends and configured to be positioned adjacent the head member of the rough opening, the head liner including a head liner channel configured to face upward away from the rough opening, the head liner including a first connection port formed into the first end of the head liner and a second connection portion formed into the second end of the head liner;

a first jamb liner configured to be positioned adjacent the first jamb member of the rough opening and including a first jamb liner channel configured to be aligned with the sill liner channel and the first connection port of the head liner channel such that fluid can flow from the head liner channel to the first jamb liner channel via the first connection port and from the first jamb liner channel to the sill liner channel; and a second jamb liner configured to be positioned adjacent the second jamb member of the rough opening and including a second jamb liner channel configured to be aligned with the sill liner channel and the second connection port of the head liner channel such that fluid can flow from the head liner channel to the second jamb liner channel via the second connection port and from the second jamb liner channel to the sill liner channel.

14. A water management system for installation in a rough opening in a building structure, the system comprising:

a sill liner configured to be positioned adjacent a sill of the rough opening and including a sill liner channel that faces upward toward the rough opening;

a head liner having first and second ends and configured to be positioned adjacent a head member of the rough opening, the head liner including a head liner channel configured to face upward away from the rough opening, the head liner including a first connection port formed into the first end of the head liner and a second connection portion formed into the second end of the head liner;

a first jamb liner configured to be positioned adjacent a first jamb member of the rough opening and including a first jamb liner channel configured to be aligned with the sill liner channel and the first connection port of the head liner channel such that fluid can flow from the head liner channel to the first jamb liner channel via the first connection port and from the first jamb liner channel to the sill liner channel; and a second jamb liner configured to be positioned adjacent a second jamb member of the rough opening and including a second jamb liner channel configured to be aligned with the sill liner channel and the second connection port of the head liner channel such that fluid can flow from the head liner channel to the second jamb liner channel via the second connection port and from the second jamb liner channel to the sill liner channel.

* * * * *